US012232520B2

(12) United States Patent
Atkin

(10) Patent No.: US 12,232,520 B2
(45) Date of Patent: Feb. 25, 2025

(54) CYLINDRICAL ROTATABLE SMOKING DEVICE

(71) Applicant: Benjamin Ray Atkin, Salt Lake City, UT (US)

(72) Inventor: Benjamin Ray Atkin, Salt Lake City, UT (US)

( * ) Notice: Subject to any disclaimer, the term of this patent is extended or adjusted under 35 U.S.C. 154(b) by 527 days.

(21) Appl. No.: 17/668,667

(22) Filed: Feb. 10, 2022

(65) Prior Publication Data

US 2022/0264939 A1 Aug. 25, 2022

Related U.S. Application Data

(60) Provisional application No. 63/149,237, filed on Feb. 13, 2021.

(51) Int. Cl.

| | |
|---|---|
| ***A24F 1/28*** | (2006.01) |
| ***A24F 5/04*** | (2006.01) |
| ***A24F 7/00*** | (2006.01) |
| ***A24F 9/02*** | (2006.01) |

(52) U.S. Cl.

CPC ..... *A24F 1/28* (2013.01); *A24F 5/04* (2013.01); *A24F 7/00* (2013.01); *A24F 9/02* (2013.01)

(58) Field of Classification Search

CPC ..... A24F 9/02; A24F 1/28; A24F 7/00; A24F 7/02; A24F 5/04

See application file for complete search history.

(56) References Cited

U.S. PATENT DOCUMENTS

| | | | | |
|---|---|---|---|---|
| 265,571 | A | 10/1882 | Bushnell | |
| 1,649,614 | A * | 11/1927 | Redheffer | A24F 9/02 131/247 |
| 4,044,807 | A | 8/1977 | Swainson | |
| 2018/0035709 | A1* | 2/2018 | Lara, Jr. | A24F 1/16 |
| 2020/0253271 | A1 | 8/2020 | Peirce et al. | |
| 2021/0037882 | A1 | 2/2021 | Barenboym | |
| 2021/0204605 | A1* | 7/2021 | Bergstrom | A61M 15/0021 |

FOREIGN PATENT DOCUMENTS

WO 2021108848 A1 6/2021

* cited by examiner

*Primary Examiner* — Michael H. Wilson
*Assistant Examiner* — Daniel Edward Vakili
(74) *Attorney, Agent, or Firm* — Gurr & Brande, PLLC; Robert A. Gurr

(57) ABSTRACT

A smoking device has an inner cylinder receivable within an outer cylinder, the inner cylinder having a combustion chamber, an air chamber, a mouthpiece, and one or more air chamber slots and combustion chamber slots; the outer cylinder having a bore hole for receiving the inner cylinder, a smoke channel, and one or more bore slots. In some examples, the inner cylinder and outer cylinder have one or more magnets for securing the inner cylinder to the outer cylinder and for aligning the air and combustion chamber slots with the bore slots. A user may rotate the inner cylinder in relation to the outer cylinder, thereby changing which air and combustion slots are aligned with the bore slots and the smoke channel. As a result of the various alignments, a user is able to vary the temperature, taste, fuel-to-air ratio, and other factors.

6 Claims, 8 Drawing Sheets

CYLINDRICAL ROTATABLE SMOKING DEVICE

CROSS-REFERENCE TO RELATED APPLICATIONS

This application claims the benefit of U.S. Provisional Application Ser. No. 63/149,237, filed on Feb. 13, 2021, which is incorporated herein by reference.

TECHNICAL FIELD

The present disclosure relates to devices for smoking. More particularly, the present disclosure relates to a hand-held cylindrical rotatable device for smoking.

BACKGROUND

Smoking is a tradition that dates back thousands of years. Advancements in cultivation, harvesting, and manufacturing led to mass production of smoking devices, such as the cigarette. There are now many ways of smoking substances; such devices include cigars, joints, hand pipes, bubblers, bongs or other waterpipes, dab rigs, hookahs, e-cigarettes, dry-herb vaporizers, etc. However, these devices are smelly, indiscreet, bulky, and lack desirable smoking features. For example, the ability to adjust smoke direction, temperature, and other features is lacking in the art.

Additionally, these devices typically use more substance than is necessary for inhaling, often producing smoke that is not inhaled, which is undesirable.

Accordingly, there is a need for a smoking device that is small, discreet, reduces ambient smoke and waste, and is made from premium materials that are easy to clean and unlikely to be broken, damaged, or corroded. The present disclosure seeks to solve these and other problems.

SUMMARY OF EXAMPLE EMBODIMENTS

In some embodiments, a smoking device comprises an inner cylinder receivable within an outer cylinder, the inner cylinder comprising a combustion chamber, an air chamber, a mouthpiece, and one or more air chamber slots and combustion chamber slots; the outer cylinder comprising a bore hole for receiving the inner cylinder, a smoke channel, and one or more bore slots. In some embodiments, the inner cylinder and outer cylinder comprise one or more magnets for securing the inner cylinder to the outer cylinder and for aligning various combinations of the air and combustion chamber slots with the bore slots and smoke channel.

In some embodiments, a user may rotate the inner cylinder in relation to the outer cylinder, thereby changing which air and/or combustion chamber slots are aligned with the bore slots and smoke channel. As a result of the various alignments, a user is able to vary the temperature, taste, fuel-to-air ratio, and other factors.

DETAILED DESCRIPTION OF EXAMPLE EMBODIMENTS

Figure 1:
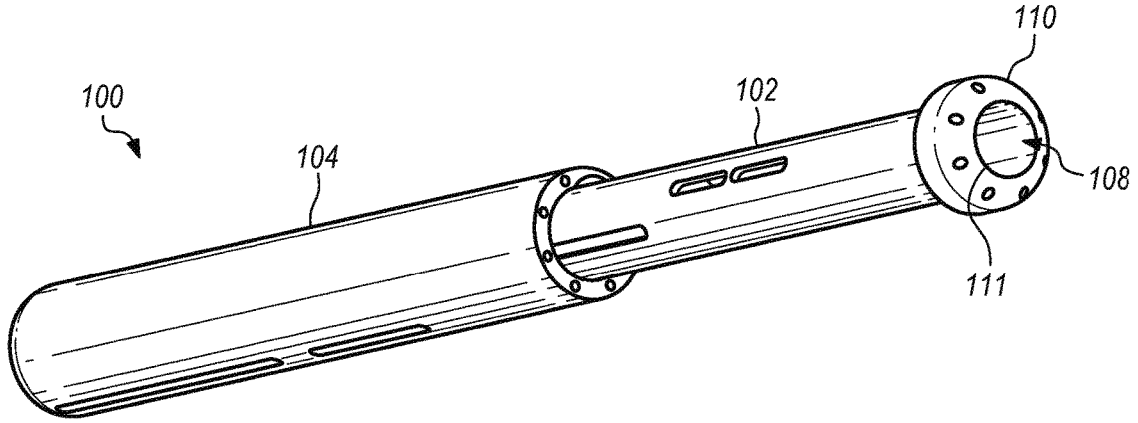
FIG. 1 is a front, side perspective view of a smoking device partially disassembled.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As discussed earlier, there is need for a smoking device that is small, discreet, reduces ambient smoke and waste, and is made from premium materials that are easy to clean and unlikely to be broken, damaged, or corroded. The smoking device disclosed herein solves these and other problems.

In some embodiments, as shown in FIGS. 1-13B, a smoking device 100 comprises an inner cylinder 102 receivable within an outer cylinder 104, the inner cylinder comprising a combustion chamber 106 separated from an air chamber 108 by a wall 107, a mouthpiece 110 comprising an air chamber aperture 111, one or more combustion chamber slots 112A-D, and one or more air chamber slots 113A-D. The outer cylinder 104 comprises a bore hole 114 for receiving the inner cylinder 102, a smoke channel 116, and one or more bore slots 118A-B. In some embodiments, the inner cylinder 102 comprises one or more magnets 120A-G for securing the inner cylinder 102 to one or more magnets 122A-G of the outer cylinder 104 and for aligning the combustion chamber slots 112A-D with bore slot 118B and aligning air chamber slots 113A-D with bore slots 118A.

In some embodiments, the smoking device 100 is manufactured from aluminum. However, it will be appreciated that any suitable material (e.g., heat/fire resistant, durable, etc.) or combination of materials may be used, such as stainless steel, carbon fiber, glass, metals, etc. The outer cylinder 104 has an inner diameter that is greater than the outer diameter of the inner cylinder 102, allowing the inner cylinder 102 to easily slide inside the outer cylinder 104. The mouthpiece 110 is wider in diameter than the inner diameter of the outer cylinder 104, allowing the mouthpiece 110 to remain exposed. This allows a user to easily rotate the inner cylinder 102 within the outer cylinder 104 by simply grasping the mouthpiece 110 and outer cylinder 104 and rotating one or the other, or both in opposite directions. As the inner cylinder 102 rotates within the outer cylinder 104, different air chamber slots 113A-D and combustion chamber slots 112A-D align with the bore slots 118A-B, respectively. Each alignment may be secured via the magnets 120A-G, 122A-G. For example, as a user twists the mouthpiece 110, thereby rotating the inner cylinder 102 in relation to the outer cylinder 104, the magnet 120A realigns with magnet 122B, "clicking" into place and aligning an air chamber slot 113A-D and/or combustion chamber slot 112A-D with the bore slots 118A-B, respectively and/or the smoke channel 116. The magnets 120A-G may be embedded in an underside 121 of the mouthpiece 110 (FIG. 2) and the magnets 122A-G may be embedded within the top 123 of the outer cylinder 104 (FIGS. 3A-3B).

Figure 2:
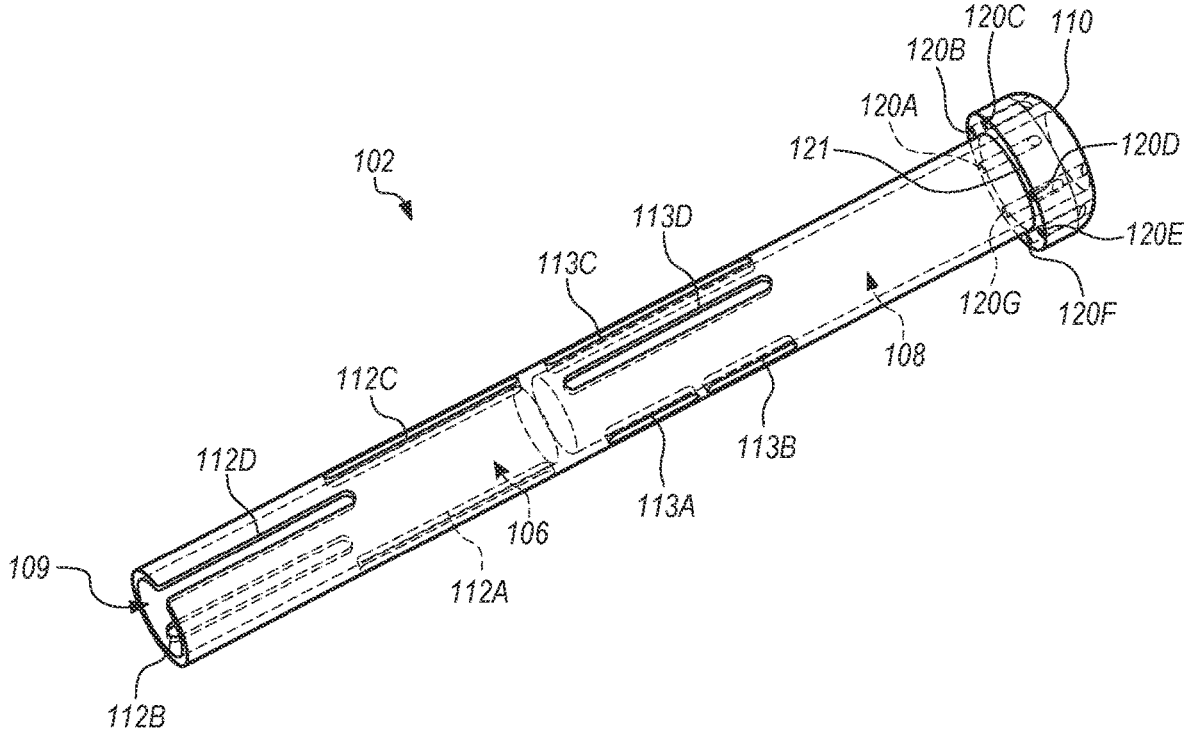
FIG. 2 is a side, transparent perspective view of an inner cylinder of a smoking device.
Figure 3A:
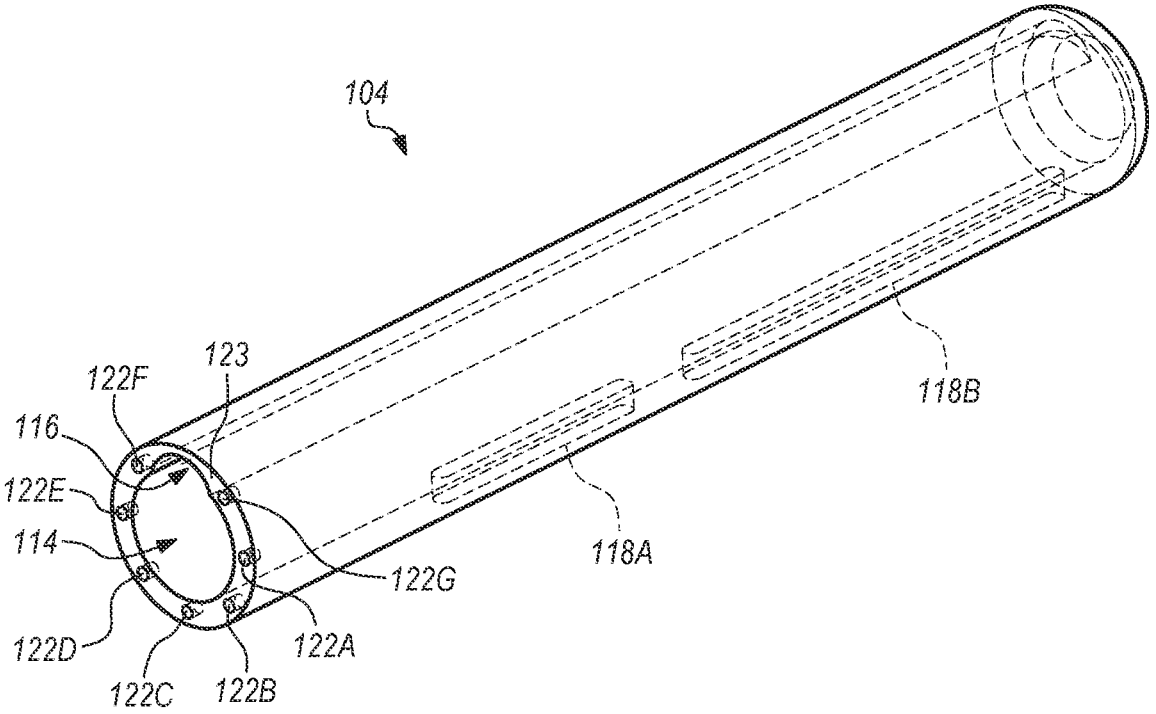
FIG. 3A is a front, side transparent perspective view of an outer cylinder of a smoking device.
Figure 3B:
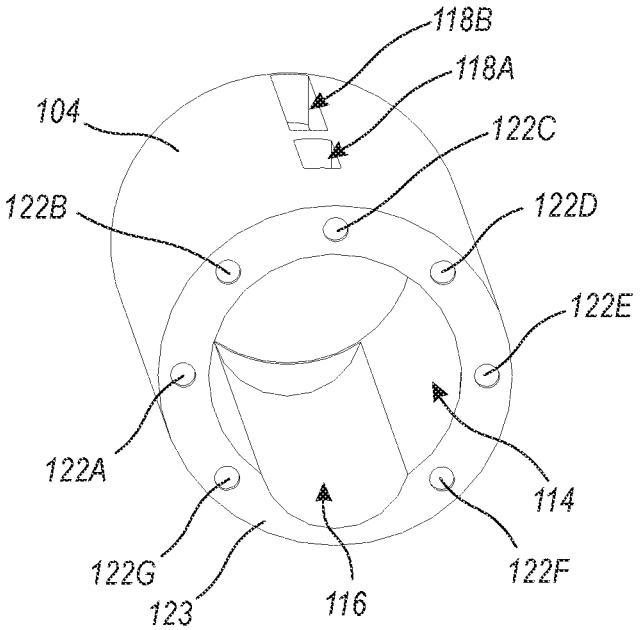
FIG. 3B is a front, top perspective view of an outer cylinder of a smoking device.

As best seen in FIG. 2, in some embodiments, there are a plurality of combustion chamber slots 112A-D and a plurality of air chamber slots 113A-D on the inner cylinder 102. In some configurations, at least one combustion chamber slot 112A-D may align with a bore slot 118B and at least one air chamber slot 113A-D may align with bore slot 118A. In some configurations, only one air chamber slot 113A-D or combustion chamber slot 112A-D may align with a respective bore slot 118A-B. In some configurations, no air chamber slots 113A-D or combustion chamber slots 112A-D are aligned with the bore slots 118A-B, thereby fully enclosing the combustion chamber 106 and the air chamber 108 in the outer cylinder 104.

Figure 7A:
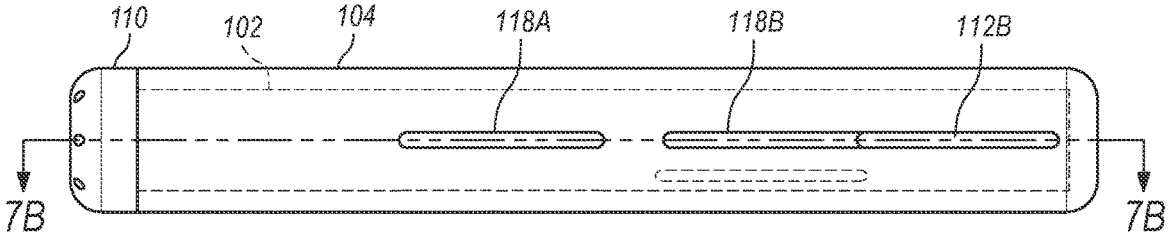
FIG. 7A is a top plan view of a smoking device in a first configuration.
Figure 7B:
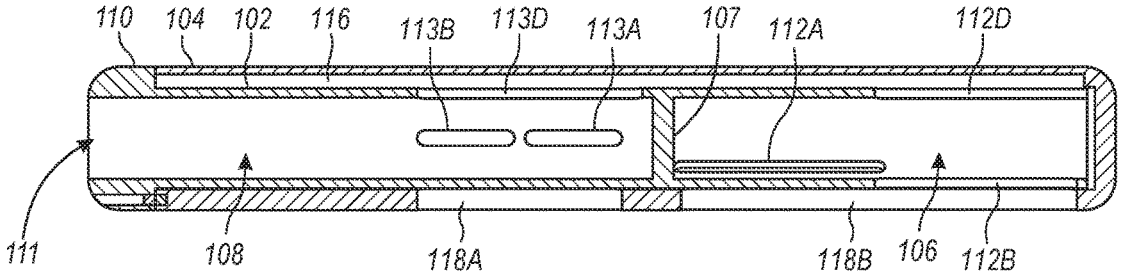
FIG. 7B is a cross-section along the lines 7B-7B in FIG. 7A.

For example, as shown in FIGS. 7A-7B, in a first configuration, combustion chamber slot 112B is aligned with bore slot 118B. In this configuration, a user has access to ignite or apply heat to the substance within the combustion chamber 106 through the alignment of the combustion chamber slot 112B and bore slot 118B. Combustion chamber slot 112D allows smoke to enter the smoke channel 116, where it passes into the air chamber 108 through air chamber slot 113D and to a user through air chamber aperture 111.

Figure 8A:
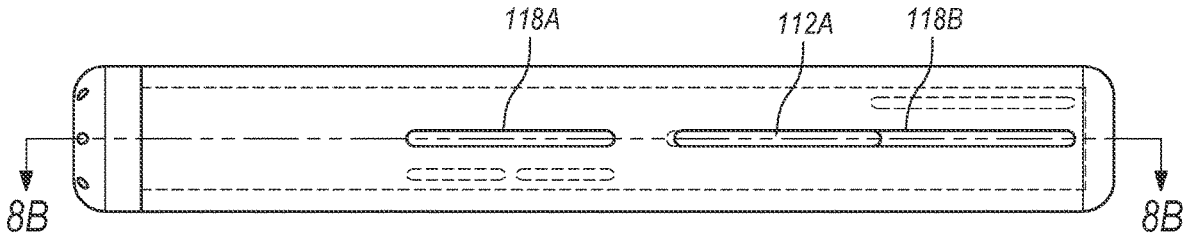
FIG. 8A is a top plan view of a smoking device in a second configuration.
Figure 8B:
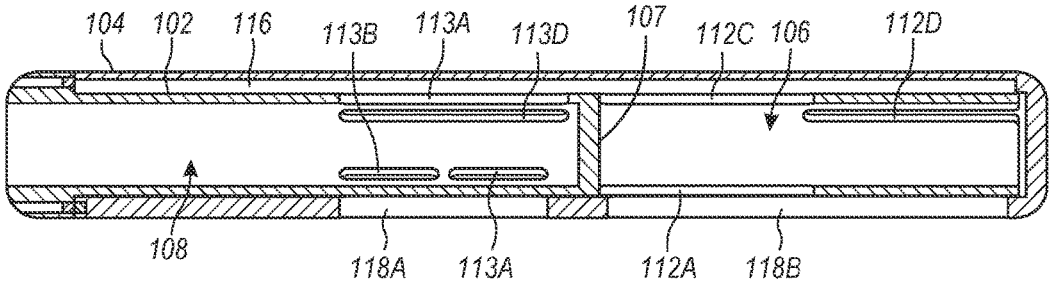
FIG. 8B is a cross-section along the lines 8B-8B in FIG. 8A.
Figure 9A:
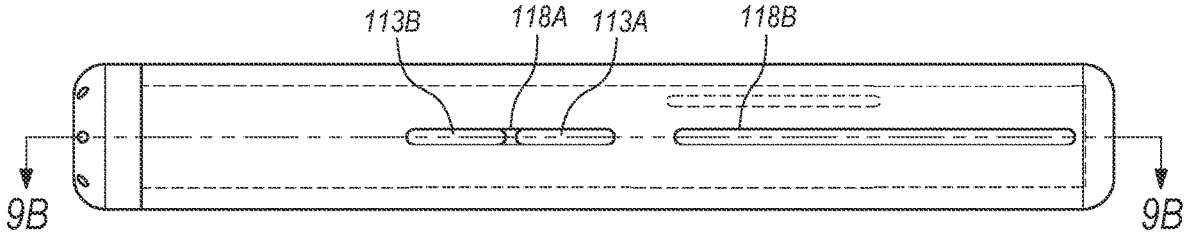
FIG. 9A is a top plan view of a smoking device in a third configuration.
Figure 9B:
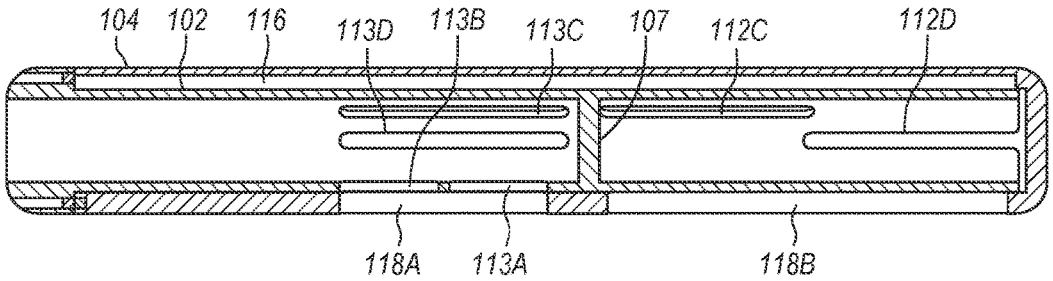
FIG. 9B is a cross-section along the lines 9B-9B in FIG. 9A.

Referring to FIGS. 8A-8B, in a second configuration, combustion chamber slot 112A is aligned with bore slot 118B, with combustion chamber slot 112C and air chamber slot 113A both aligning with the smoke channel 116. Referring to FIGS. 9A-9B, in a third configuration, air chamber slots 113A-B are aligned with bore slot 118A. In this configuration, the combustion chamber 106 is enclosed, extinguishing any burning, while air chamber slots 113A-B allow fresh air to enter into the air chamber 108 while a user continues to inhale, clearing it of smoke.

Figure 10A:
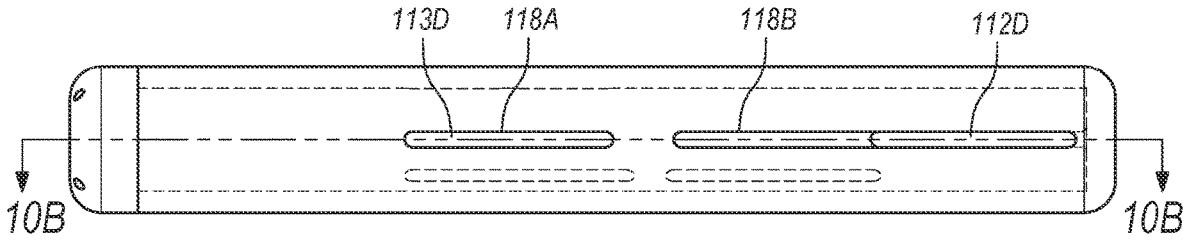
FIG. 10A is a top plan view of a smoking device in a fourth configuration.
Figure 10B:
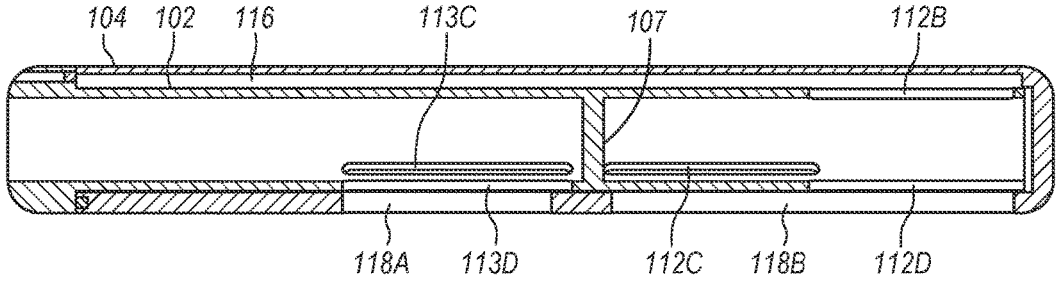
FIG. 10B is a cross-section along the lines 10B-10B in FIG. 10A.
Figure 11A:
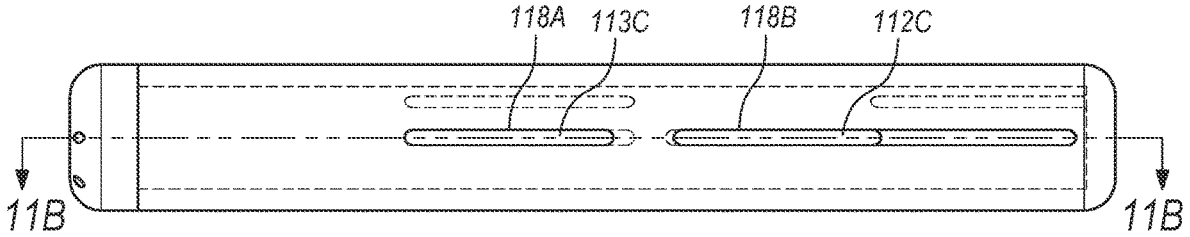
FIG. 11A is a top plan view of a smoking device in a fifth configuration.
Figure 11B:
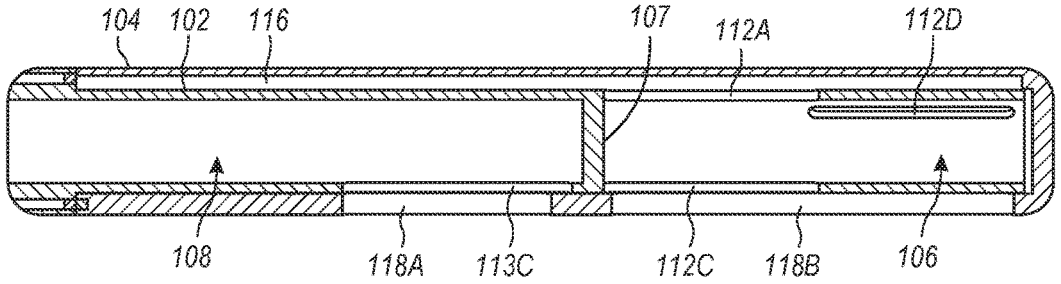
FIG. 11B is a cross-section along the lines 11B-11B in FIG. 11A.
Figure 12A:
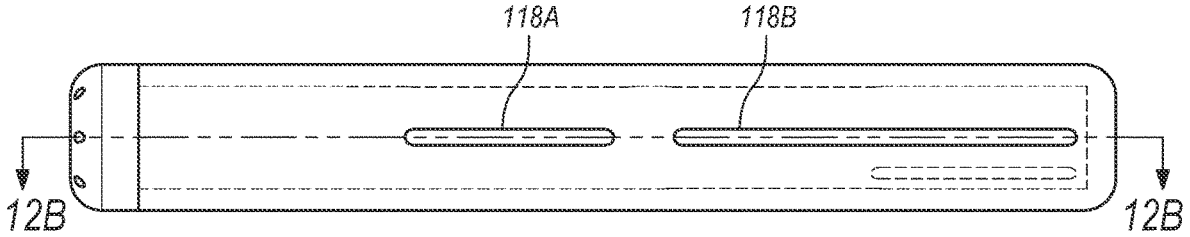
FIG. 12A is a top plan view of a smoking device in a sixth configuration.
Figure 12B:
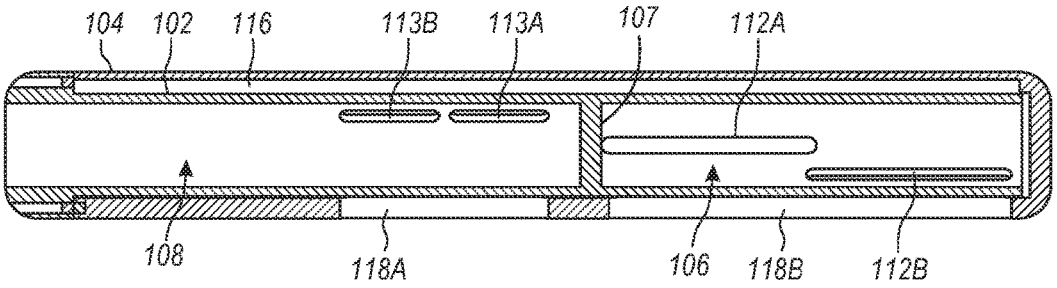
FIG. 12B is a cross-section along the lines 12B-12B in FIG. 12A.

Referring to FIGS. 10A-B, in a fourth configuration, air chamber slot 113D is aligned with bore slot 118A and combustion chamber slot 112D is aligned with bore slot 118B. Referring to FIGS. 11A-11B, in a fifth configuration, air chamber slot 113C is aligned with bore slot 118A and combustion chamber slot 112C is aligned with bore slot 118B. Referring to FIGS. 12A-12B, in a sixth, closed configuration, no air chamber slots 113A-D or combustion chamber slots 112A-D are aligned with either bore slot 118A-B, nor are they aligned with the smoke chamber 116.

It will be appreciated that a user may rotate the inner cylinder 102 in relation to the outer cylinder 104, thereby changing which air chamber slots 113A-D and combustion chamber slots 112A-D are aligned with the bore slots 118A-B, respectively. Depending upon the alignment, a user is able to vary the temperature, taste, fuel-to-air ratio, and other factors. While configurations are described and illustrated, it will be appreciated that more or fewer configurations are possible without departing herefrom. Further, it will also be appreciated that any of the slots disclosed herein may vary in size, location, and number without departing herefrom.

Figure 4:
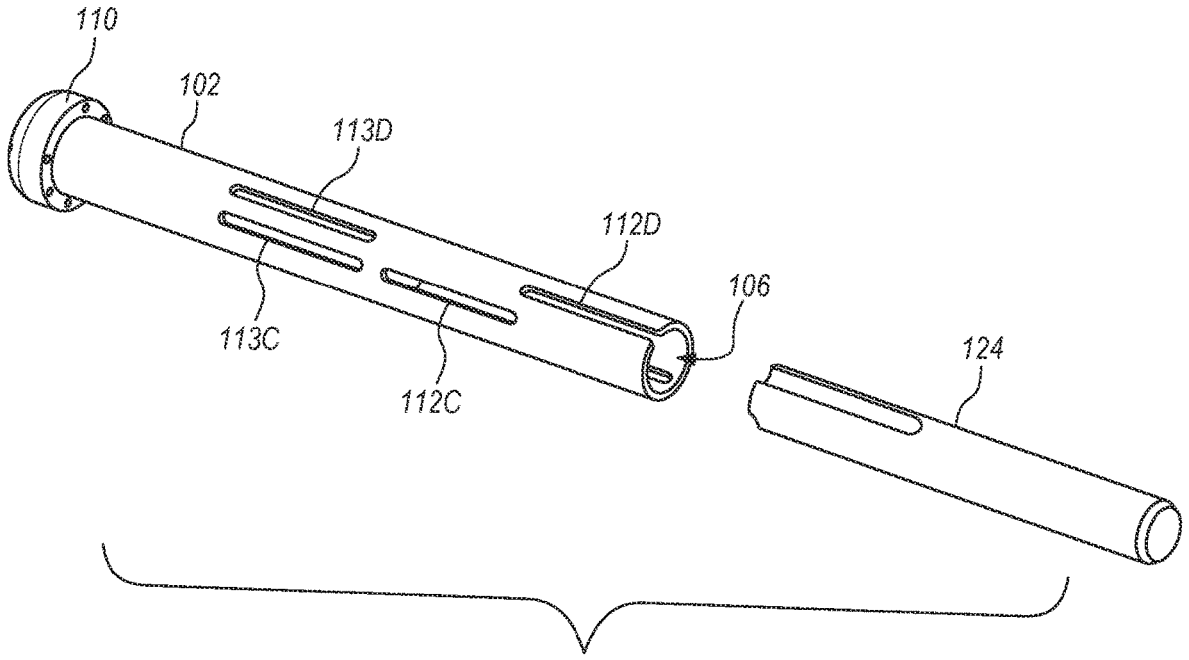
FIG. 4 is a rear, side perspective view of an inner cylinder and tamping rod of a smoking device.
Figure 5:
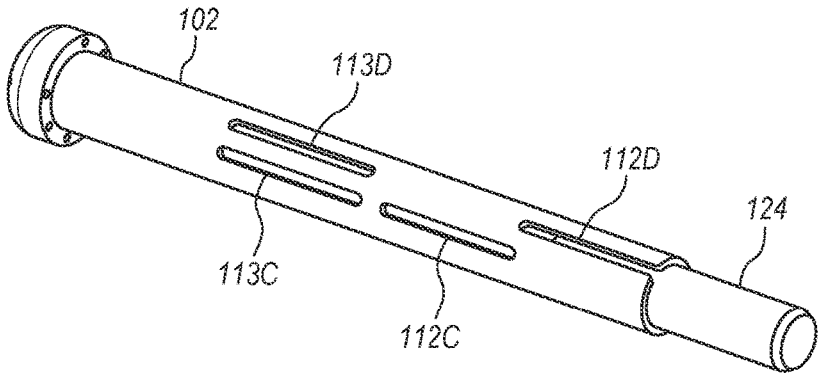
FIG. 5 is a rear, side perspective view of an inner cylinder with a tamping rod inserted into the combustion chamber of a smoking device.
Figure 6:
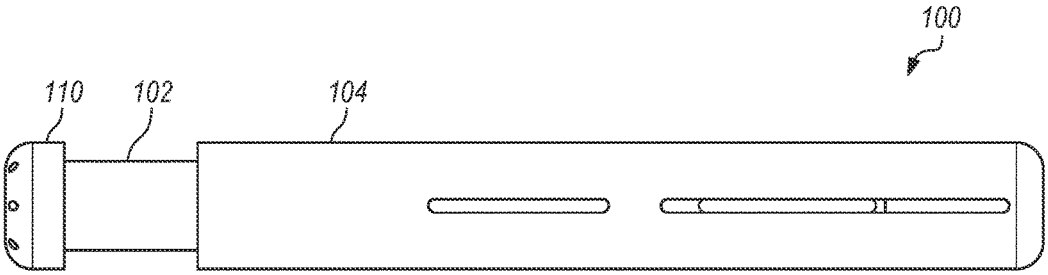
FIG. 6 is a top plan view of an inner cylinder partially inserted into an outer cylinder of a smoking device.

Therefore, in one method of use, a user would withdraw the inner cylinder 102 from the outer cylinder 104 and would then load the desired substance, ingredient, or material into the combustion chamber 106 through rear opening 109 (FIG. 2). In some embodiments, as shown in FIGS. 4-5, a user may use a tamping rod 124 to tamp the desired substance within the combustion chamber 106. Once the combustion chamber 106 is loaded with substance, the user inserts the inner cylinder 102 into the outer cylinder 104 until the mouthpiece 110 abuts the outer cylinder 104 and the magnets 120A-G in the mouthpiece magnetically couple to the magnets 122A-G in the outer cylinder 104, securing the inner cylinder 102 to the outer cylinder 104.

A user may grip and twist either the mouthpiece 110 and/or the outer cylinder 104 so as to select the desired configuration (e.g., FIGS. 7A-12B). When substance is exposed by the alignment of a combustion chamber slot 112A-D with bore slot 118B, a user may ignite the substance with a lighter, match, torch, etc. (or otherwise apply heat for dry-herb vaporizing). With the user's lips on the mouthpiece 110, a user may then inhale, creating suction through one or more air chamber slots 113A-D, which pulls smoke from the combustion chamber 106 via the smoke channel 116 and into the air chamber 108 where it passes to a user via the mouthpiece 110.

In some embodiments, a user may rotate the cylinders 102, 104 while inhaling so as to alter the experience. Additionally, as shown in FIGS. 12A-B, a user may close the smoking device 100 by rotating the inner cylinder 102 such that none of the combustion chamber slots 112A-D or air chamber slots 113A-D are aligned with the bore slots 118A-B. In this closed configuration, none of the air chamber slots 113A-D are aligned with the smoke channel 116 either, reducing or preventing smoke from exiting the smoke device 100. In one embodiment, a user would first rotate the inner cylinder to the configuration shown in FIGS. 9A-9B to clear the air chamber 108 of smoke, then rotate to the closed configuration of FIGS. 12A-12B to ensure the air chamber 108 and combustion chamber 106 remain enclosed. This helps to ensure that the substance ceases to burn (closing the device 100 extinguishes any burning) and that smoke does not continue to be emitted from the smoking device 100 (a smokefree configuration). This allows a user to have the substance therein last longer, while simultaneously reducing secondhand smoke, something that the prior art has not achieved.

While described above as igniting the substance with a lighter, match, torch, etc., it will be appreciated that the substance need not be ignited. For example, in some embodiments, heat may be applied to the substance (i.e., conduction) for dry-herb vaporizing. In some embodiments, hot air may be applied to the substance (i.e., convection) for dry-herb vaporizing.

Additionally, a user may couple the smoking device 100 to a waterpipe or other device so as to reduce ambient smoke. For example, a user may couple the mouthpiece 110 to the downstem of the waterpipe, ignite the substance through the aligned combustion chamber slots 112A-D and bore slots 118B, begin inhaling the resulting smoke through the waterpipe, and, while still inhaling, rotate the outer cylinder 104 to the configuration of FIGS. 9A-9B, thereby extinguishing the burning substance in the combustion chamber 106, while inhaling the remaining smoke from the waterpipe. As a result, when a user lifts their mouth from the waterpipe, no smoke is left to exit the waterpipe. This allows for a reduced smoke environment when using a waterpipe. The ability to smoke discreetly, and with less impact on the surroundings, is an improvement over the prior art.

Figure 13A:
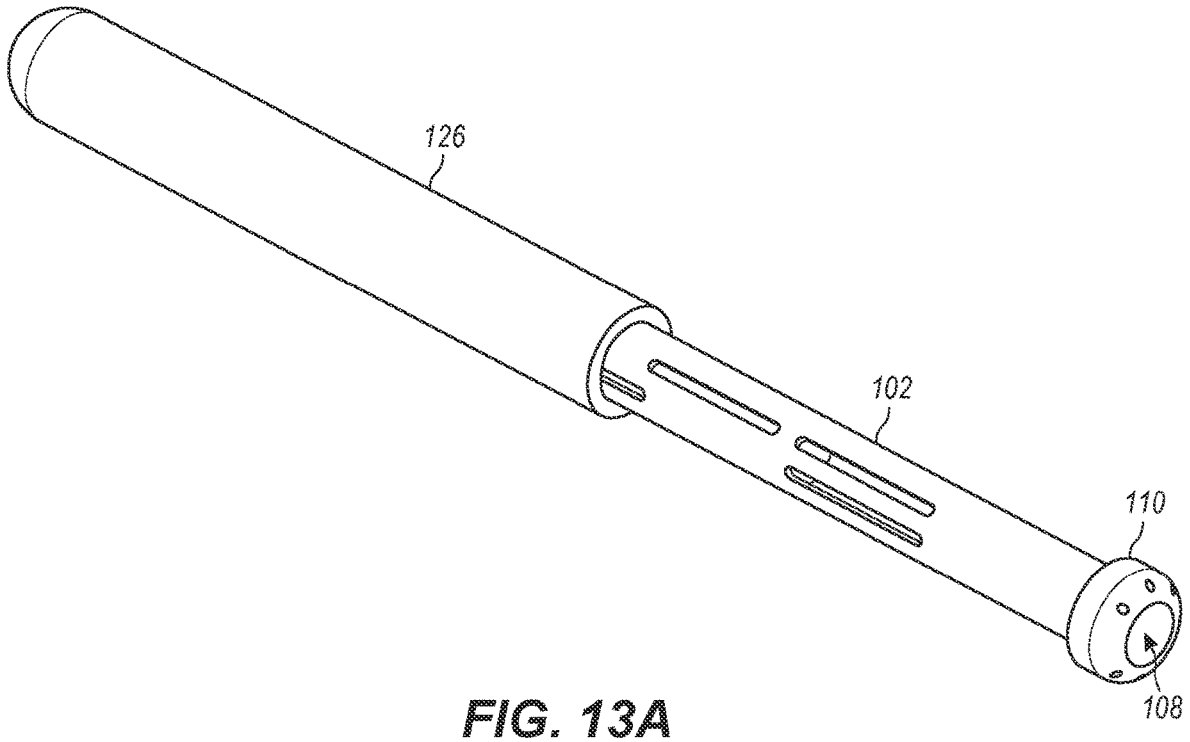
FIG. 13A is a front perspective view of an inner cylinder partially inserted into a sleeve of a smoking device.
Figure 13B:
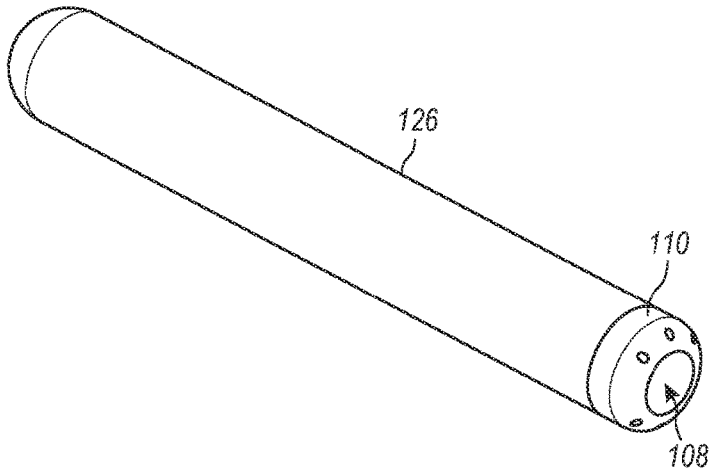
FIG. 13B is a front perspective view of an inner cylinder fully inserted into a sleeve of a smoking device.

In some embodiments, as shown in FIGS. 13A-B, the inner cylinder 102 may be inserted into a sleeve 126. The sleeve 126 may be used to store/transport an inner cylinder 102 loaded with a desired substance. For example, a user may have several inner cylinders 102 pre-loaded and stored in sleeves 126 for easy and quick use. In this way, a user may withdraw a loaded inner cylinder 102 from the sleeve 126 and insert it into the outer cylinder 104 for use. The emptied inner cylinder 102 may be inserted into the sleeve 126 for storage until it can be cleaned and reloaded. This is especially convenient when a user is out and about, allowing them to have "refills" ready for use that may be stored in pocket, briefcase, etc.

Cleaning the smoking device 100 is easily accomplished as well by simply withdrawing the inner cylinder 102 from the outer cylinder 104 and then washing with soap and water. Additionally, the sleeve 126 may be used to assist in cleaning the inner cylinder 102. For example, soaps or cleaners may be inserted into the sleeve 126, followed by the inner cylinder 102. A user may then repeatedly withdraw and insert the inner cylinder 102, as well as shake when inserted, so as to get a thorough cleaning. Additionally, the tamping rod 124 may also be used to assist in cleaning. For example, the tamping rod 124 may inserted within the combustion chamber 106 while in the sleeve to aid in agitating any remaining contents in the combustion chamber 106, thereby freeing those contents and clearing the inner cylinder 102. It will be appreciated that the sleeve 126 may be made from silicone, rubber, plastic, etc.

As appreciated from the foregoing, the smoking device 100 disclosed herein solves the need for a smoking device that is small, discreet, reduces ambient smoke and waste, and is made from premium materials that are easy to clean and unlikely to be broken, damaged, or corroded.

It will also be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A smoking device, comprising:

an inner cylinder, comprising:

an air chamber, the air chamber comprising one or more air chamber slots, and a combustion chamber, the combustion chamber comprising one or more combustion chamber slots;

an outer cylinder, comprising:

a bore hole sized to receive the inner cylinder, a smoke channel, and one or more bore slots;

wherein the inner cylinder is rotatable within the outer cylinder; and wherein the inner cylinder is rotated to align at least one air chamber slot with one of the one or more bore slots, with no combustion chamber slots aligned with one or more bore slots.

2. The smoking device of claim 1, wherein the inner cylinder comprises a mouthpiece.

3. The smoking device of claim 2, wherein the mouthpiece further comprises magnets.

4. The smoking device of claim 1, wherein the outer cylinder comprises magnets.

5. The smoking device of claim 1, comprising a tamping rod.

6. The smoking device of claim 1, further comprising a sleeve configured to receive the inner cylinder.

* * * * *